United States Patent [19]

Blanchot

[11] Patent Number: 4,730,555

[45] Date of Patent: Mar. 15, 1988

[54] WINE PRESS WITH HORIZONTALLY ORIENTED ROTATABLE PLATEN

[75] Inventor: Claude F. Blanchot, Reims, France

[73] Assignee: Ateliers Coquard S.A.R.L., Reims, France

[21] Appl. No.: 922,463

[22] Filed: Oct. 23, 1986

[30] Foreign Application Priority Data

Oct. 31, 1985 [FR] France ..... 85 16341

[51] Int. Cl.[4] ..... B30B 9/06

[52] U.S. Cl. ..... 100/37; 100/127; 100/130; 100/295

[58] Field of Search ..... 100/37, 127, 130, 131, 100/232, 264, 244, 107, 295, 116, 179, 132

[56] References Cited

U.S. PATENT DOCUMENTS

| | | | |
|---|---|---|---|
| 3,513,769 | 5/1970 | Sutter-Christ | 100/107 |
| 4,214,519 | 7/1980 | Stollenwerk et al. | 100/37 |
| 4,350,089 | 9/1982 | Braun . | |
| 4,646,633 | 3/1987 | Falguieres | 100/37 |

FOREIGN PATENT DOCUMENTS

| | | | |
|---|---|---|---|
| 135482 | 2/1901 | Fed. Rep. of Germany . | |
| 2405107 | 9/1974 | Fed. Rep. of Germany | 100/127 |
| 2459411 | 7/1975 | Fed. Rep. of Germany | 100/127 |
| 2945254 | 5/1981 | Fed. Rep. of Germany . | |
| 531263 | 1/1922 | France . | |
| 611288 | 9/1926 | France . | |
| 2127935 | 10/1972 | France . | |
| 2469274 | 5/1981 | France . | |

*Primary Examiner*—Andrew M. Falik

*Attorney, Agent, or Firm*—Cushman, Darby & Cushman

[57] ABSTRACT

An extractor includes a cage which is delimited in the bottom part by a rotating perforated circular platen (1) surmounted by two vertical fixed perforated panels (6) on whose upper edge a cover (7) rests. The cover includes one or more hinged panels, and between which two thrust platens (8 and 9) slide. The thrust platens are displaced by cylinders (10 and 11). The rotating perforated circular platen (1) and the recovery tank (12) are each equipped with a trap (13 and 15). The traps are arranged in vertical alignment with one another and forming, in the open position, a hopper for discharging the residues towards a removal device (14). The process mainly consists in rotating the perforated circular platen (1) during charging and then through 90° between two pressing phases so as to press the cake in two perpendicular directions. Typically, the apparatus is used for pressing grapes.

12 Claims, 6 Drawing Figures

WINE PRESS WITH HORIZONTALLY ORIENTED ROTATABLE PLATEN

BACKGROUND OF THE INVENTION

The invention relates to an extractor for substances containing a liquid.

The extraction of liquids from certain vegetable substances, such as grapes, has hitherto been carried out using vertical presses of the screw or hydraulic type, or horizontal presses of the type with compression by means of an inflatable diaphragm or with compression by means of opposing circular platens, displacement being provided by cylinders or screws.

On vertical presses, each extraction cycle is followed by a manual breaking-up operation using shovels and forks.

On pneumatic horizontal presses, the breaking-up operation is performed mechanically, by rotation of the cage, after decompression of the diaphragm.

On horizontal presses with compression by means of opposing circular platens, this operation is carried out by rotation of the cage together with retraction of the platens, which, in order to make the mixing process more efficient, are in some cases joined by rings and chains.

Although mechanization of the breaking-up operation has dispensed with laborious manual interventions, it has introduced crushing and grinding processes which impair quality (sludge and turbidity)

A press is already known which is disclosed as prior art in West German Pat. No. 2945254; it is a pneumatic press with a vat rotating about a longitudinal and horizontal axis, which has a filling and emptying aperture and is closed by a filter cover, while a compression diaphragm, similar in shape to the vat and arranged coaxially to the axis of rotation of the vat, is mounted inside the vat, the said diaphragm thus dividing the vat into a pressure chamber and an extraction chamber. This extractor has the advantage of exerting a uniformly distributed pressure on the substance, resulting in a gentle pressing at low pressure. This design is also suitable for a preliminary extraction by centrifugation, the vat being rotated several times without the use of pressure. The extraction operation takes place after a 180° rotation of the vat, which brings the filling aperture, equipped with a filter, to the bottom position; however, when the press-cake is broken up, it is necessary to decompress the diaphragm and then rotate the vat, causing the substance to be mixed and leaving a relatively high level of sludge and turbidity.

SUMMARY OF THE INVENTION

The object of the present invention is to overcome the disadvantages exhibited by the presses referred to above, for this invention, as characterized in the claims, solves the problem of creating an extractor for substances containing a liquid, which makes it possible to obtain a good distribution of the substances on the bottom of the cage during charging, to carry out the pressing in successive pressure stages until the desired degree of extraction is obtained. The invention also makes it possible to position the cake perpendicular to the thrust platens while at the same time retaining the central part of this cake during the breaking-up operations so that this central part can be used as a filter mass for reducing the sludge to a very low level, and to remove the residues without human intervention. The invention is suitable for complete automation of the process, from the charging stage to the residue removal stage, allowing for the state of the substances to be pressed.

The main feature of the extractor according to the invention is that it comprises a cage whose volume can be varied by opposing thrust platens and which is delimited in the bottom part by a rotating horizontal circular platen perforated on the sides by means of perforated vertical fixed panels, in the top part by one or more jointed panels forming a cover, and at the end by two vertical thrust platens displaced by cylinders or other means of this kind.

The perforated rotating horizontal circular platen is equipped at the center with one or more perforated traps jointed in the downward direction.

In vertical alignment with the trap or traps fitted to the rotating circular platen, the liquid recovery tank is equipped with a trap hanging over a device for discharging the residues and any liquids obtained, which are collected and distributed by a selector.

The perforated rotating circular platen rests on a runway. The platen is centered and rotated by wheels, one of which is motorized.

The characteristic features of the extraction proccess using the device described above are that, when the substance is introduced into the cage, the perforated rotating horizontal circular platen can be rotated so as to ensure the uniform distribution of the substance. After closure of the cage, the two thrust platens are brought together in successive pressure stages until the desired degree of extraction is obtained.

The final cake forming the residues is then removed, under its own weight, in the direction of the discharge device via the traps located in the rotating circular platen and in the recovery tank, the traps being arranged in the form of a hopper.

The advantages obtained by virtue of this invention are essentially that, in view of the immobilization of the central part of the cake and the permanent retention of a filter mass, the sludge level is very low, and that, in view of its design, the device is very easily adaptable for mechanization and for programmed automation, according to the state of the substance, of all the operations involved in the process.

Further characteristics and advantages will become apparent from the following description of a grape press constructed according to the invention, which is given by way of a non-limiting example with reference to the attached drawing.

Figure 1:
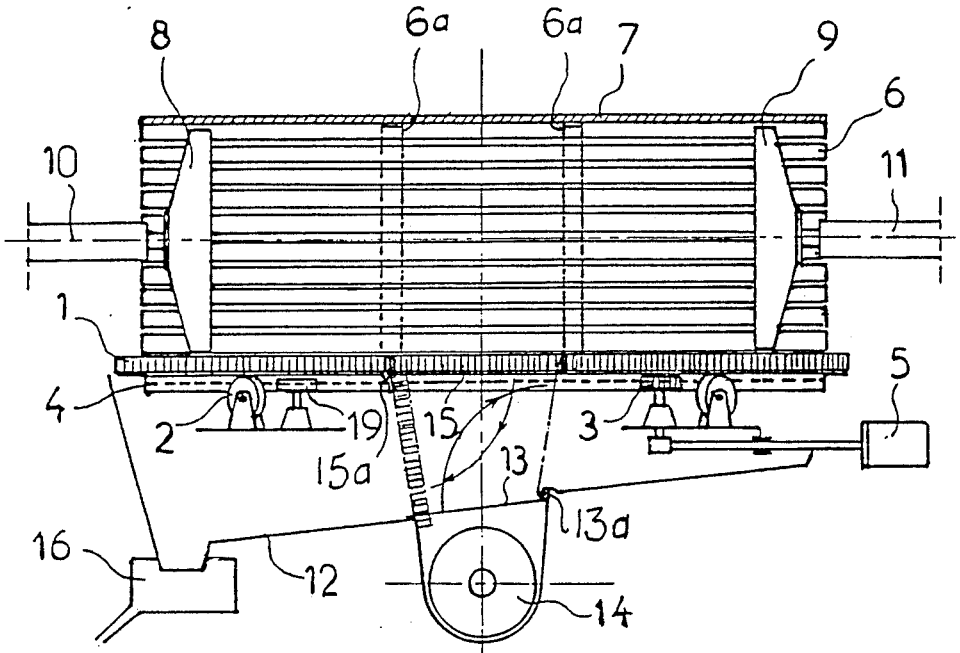
FIG. 1 shows a view of the whole press in longitudinal section.
Figure 2:
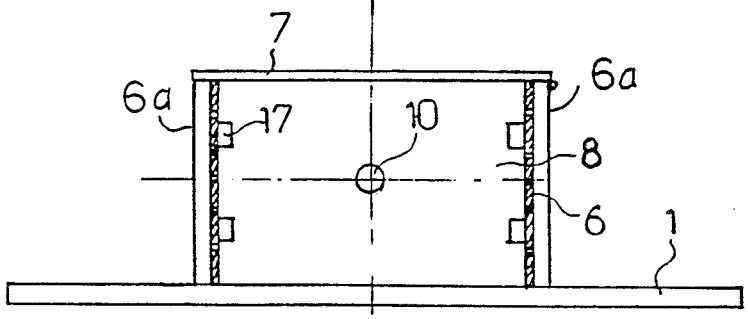
FIG. 2 shows a view of the cage in cross-section.

DETAILED DESCRIPTION The device essentially comprises a cage which consists of a perforated rotating circular platen 1 resting on rollers 2, which is centered and driven by wheels 19 and a pinion 3, a roller chain 4 and a motor 5; perforated or seated vertical fixed panels 6 arranged horizontally and joined by the upright 6a and surmounted by a cover 7; thrust platens 8 and 9 displaced by jacks or cylinders 10 and 11; and a flow tank 12 equipped with a trap 13 vertically aligned with the center of the circular platen and hanging over a discharge screw 14 comprising a removal device. The perforated rotating circular platen 1 has a trap 15 hinged in the downward direction by the hinge 15a. The liquid flow tank 12, i.e. the recovery tank, comes out into a distributing collector 16. The thrust platens 8 and 9 are guided laterally by slides 17.

The perforated vertical panels consist of hardwood or plastic boards joined by uprights.

Each thrust platen is covered on its working face with a sheet of hardwood or stainless steel.

The two thrust platens are guided laterally by slides or runways.

The trap for removing the residues, which is fitted to the recovery tank, is jointed in the upward direction by the hinge 13a so that, in the fully open position, it comes to rest against the edge of the opening in the trap located in the perforated rotating circular platen.

The leaktightness at the hinge which joints the trap for removing the residues is achieved by means of a baffle assembly.

In the open position, the trap located in the rotating circular platen comes to bear against the edge of the opening for the trap for removing the waste, thereby forming a discharge hopper with the said trap.

Figure 3:
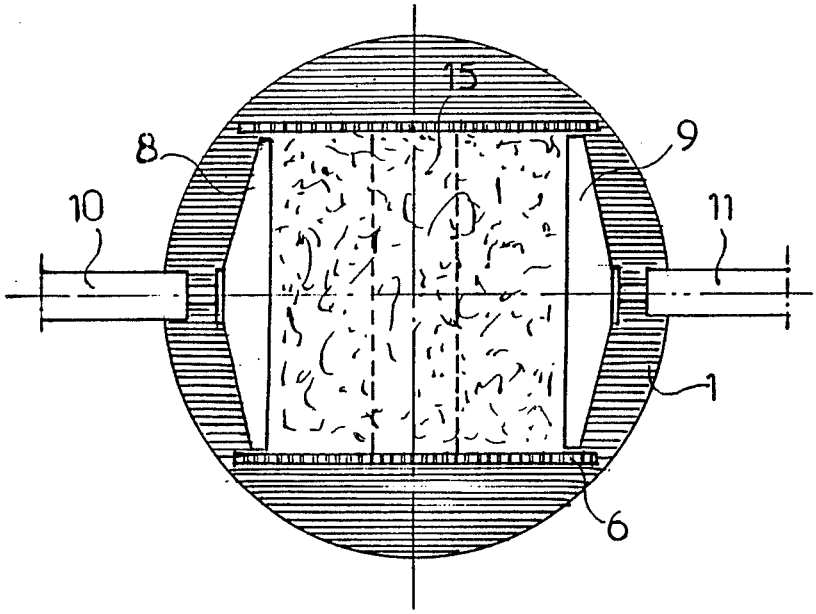
FIG. 3 shows a top view of the cage during the charging operation.
Figure 4:
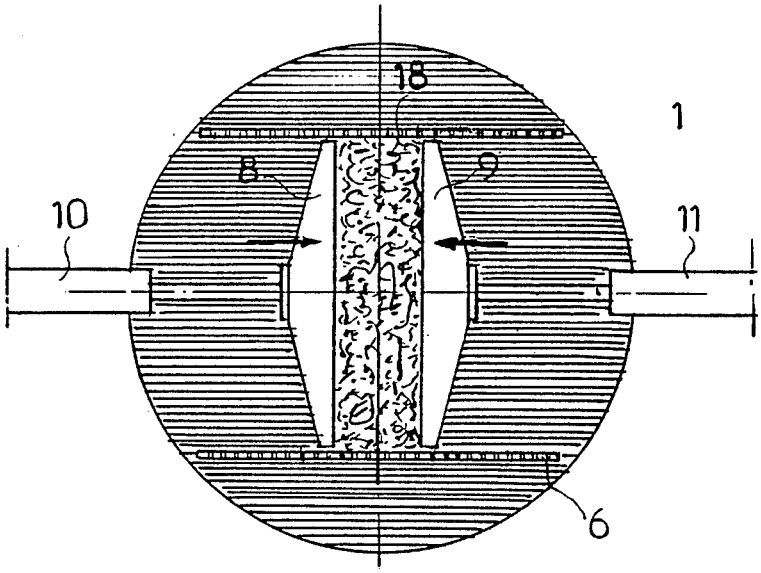
FIG. 4 shows a top view of the cage at the end of a pressing operation.
Figure 5:
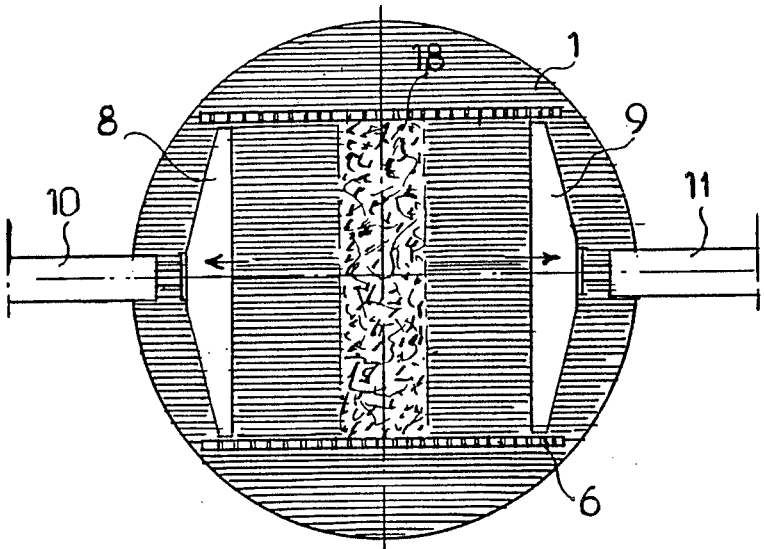
FIG. 5 shows a top view of the cage during the retraction of the thrust platens, showing the position of the cake.
Figure 6:
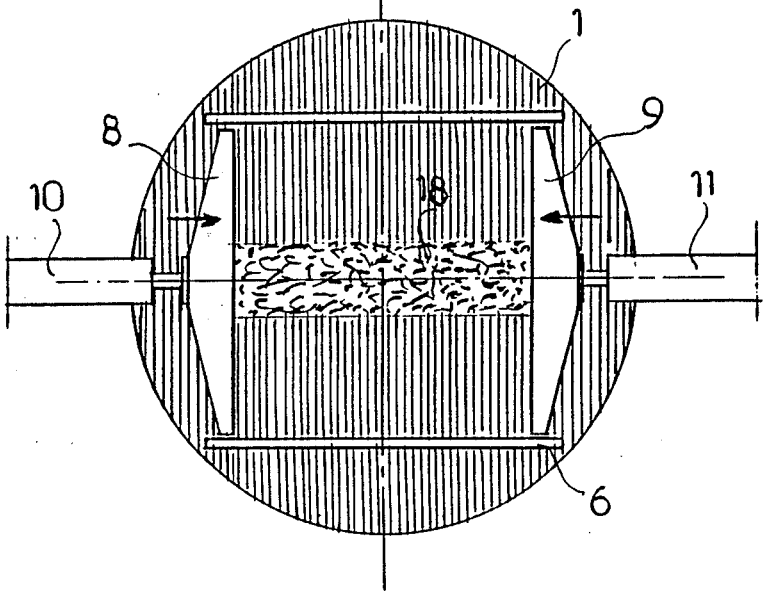
FIG. 6 shows a top view of the cage when the thrust platens begin to press against the ends of the cake after a 90° rotation of the rotating perforated platen.

Referring successively to FIGS. 3 to 6, it is seen that, when the press is charged, the substances to be pressed are distributed uniformly by rotation of the platen 1, and that, when the thrust platens 8 and 9 are retracted, the substance to be pressed has been converted to a cake 18 having cleavage planes and situated in the middle of the rotating platen 1 above the discharge trap 15. The cake 18 can then be brought perpendicular to the thrust platens 8 and 9 simply by rotating the platen 1 through 90°. During the next compression, the thrust platens move forward simultaneously at high speed, this forward movement being monitored by a pressure sensor for transition to a slow pressing speed. During this phase, a number of breaking-up operations can be carried out according to the fractions to be obtained. During the breaking-up operations, the cake is broken up along the cleavage planes around a central filter core. From the above operations a compressed part forming a filter mass, will always remain at the center of the cake 18.

With the pressing operations complete, the residues can be directly discharged using the hopper temporarily formed by the two traps 13 and 15. This is done simply by mechanically maneuvering these two traps in succession, starting with the trap 13, the platen 1 being rotated, if necessary, to bring its trap 15 above the trap 13 of the recovery tank. These operations are combined with the actuation of the screw conveyor to ensure that the waste is transferred out of the press.

While the process has been taken place, the extracted liquid has run into the recovery tank 12, passing through the apertures provided in the rotating circular platen and through the interstices existing between the boards forming the side panels of the cage.

The main application of the invention is to grape presses.

What is claimed is:

1. An extractor for a substance containing a liquid, comprising:

a horizontally oriented cage delimited in a bottom part thereof by a rotatable perforated circular platen provided at its center with at least one first perforated trap hinged to be movable in the downward direction, said rotatable perforated circular platen being surmounted by two perforated vertical fixed panels having upper edges, the upper edges of said two perforated panels bearing a cover;

two thrust platens, being displaced by jacks, sliding in said cage to vary the volume of the cage, each thrust platen having a working face;

a removal device for discharging residue from said cage;

a recovery tank placed under said rotatable perforated circular platen and provided with at least a second trap arranged in vertical alignment with the center of the rotatable perforated circular platen, said second trap providing access to said removal device for discharging residue; and a collector arranged for collecting and distributing liquid extracted from the substance by the extractor.

2. The extractor of claim 1, wherein:

said perforated vertical panels comprise a plurality of boards arranged horizontallly and joined by uprights.

3. The extractor of claim 2, wherein:

said boards are made of hardwood.

4. The extractor of claim 2, wherein:

said boards are made of plastic material.

5. The extractor of claim 1, wherein:

said rotatable perforated circular platen is centered and rotated by means of wheels, one of which is driven by a motor for rotatably driving said rotating perforated circular platen.

6. The extractor of claim 1, wherein:

each thrust platen is covered on its working face with a sheet of wood.

7. The extractor of claim 1, wherein:

each thrust platen is covered on its working face with a sheet of stainless steel.

8. The extractor of claim 1, wherein:

the thrust platens are guided by slides or runways.

9. The extractor of claim 1, wherein:

the second trap provided in the recovery tank is hinged in the upward direction, so that when the first trap is in an open position, the first trap provides an opening with an edge, and the second trap comes to bear against said edge of said opening.

10. The extractor of claim 9, wherein:

said traps provided in the rotatable circular platen and in the recovery tank make, when they are in an open position, a hopper for guiding residue towards the removal device.

11. The extractor of claim 1, wherein:

the first trap provided in the rotatable perforated circular platen is adapted to be opened in the downward direction when the second trap is in an open position so as to provide an opening with an edge, and the first trap comes to bear against said edge of said opening for said second trap.

12. A process for extracting a liquid from a substance containing such liquid to form a cake, comprising an extractor including a cage delimited in a bottom part by a rotatable horizontally oriented and perforated circular platen, two opposing thrust platens sliding in said cage to vary its volume, and a removal device for discharging said cake from said cage, wherein:

(a) the substance is introduced into the cage;

(b) the circular platen is rotated so as to make the distribution of the substance uniform;

(c) the two thrust platens are brought together in successive pressure stages until a fixed degree of extraction is reached;

(d) the two thrust platens are then rapidly retracted, to release a cake having cleavage planes therein;

(e) the circular platen is rotated 90°;

(f) the two thrust platens are moved again towards each other at a high speed to break up the cake along said cleavage planes; and (g) a final press-cake is discharged under its own weight, toward the removal device.

* * * * *